US008596005B2

(12) United States Patent
Sibbett

(10) Patent No.: US 8,596,005 B2
(45) Date of Patent: Dec. 3, 2013

(54) RAISED PROFILE PANEL FOR DOOR

(76) Inventor: Peter Yong Sibbett, Tacoma, WA (US)

( * ) Notice: Subject to any disclaimer, the term of this patent is extended or adjusted under 35 U.S.C. 154(b) by 120 days.

(21) Appl. No.: 13/087,821

(22) Filed: Apr. 15, 2011

(65) Prior Publication Data

US 2012/0159887 A1 Jun. 28, 2012

(30) Foreign Application Priority Data

Nov. 29, 2010 (KR) ..... 10-2010-0119667

(51) Int. Cl.

| | |
|---|---|
| ***E04F 13/00*** | (2006.01) |
| ***E04C 1/00*** | (2006.01) |
| ***E04C 2/38*** | (2006.01) |
| ***B44F 7/00*** | (2006.01) |
| ***E06B 3/70*** | (2006.01) |

(52) U.S. Cl.
USPC ..... 52/455; 52/311.1; 52/314; 52/718.01

(58) Field of Classification Search
USPC ..... 52/311.1, 312, 313, 314, 455, 456, 457, 52/458, 717.01, 718.01, 287.1
See application file for complete search history.

(56) References Cited

U.S. PATENT DOCUMENTS

| | | | | |
|---|---|---|---|---|
| 368,245 | A * | 8/1887 | Schumacher | 52/312 |
| 3,305,992 | A * | 2/1967 | Steed | 52/314 |
| 5,016,414 | A * | 5/1991 | Wang | 52/456 |
| 6,397,541 | B1 * | 6/2002 | Brewer | 52/316 |
| 6,524,674 | B1 * | 2/2003 | Eichhorn | 428/38 |
| 6,584,743 | B2 * | 7/2003 | Paxton et al. | 52/312 |
| 7,168,474 | B2 * | 1/2007 | Lam | 160/38 |
| 7,426,806 | B2 * | 9/2008 | Lynch et al. | 52/455 |
| 2003/0019178 | A1 * | 1/2003 | Wang Chen | 52/455 |
| 2005/0028465 | A1 * | 2/2005 | Horsfall et al. | 52/455 |
| 2006/0000173 | A1 * | 1/2006 | Edstrom | 52/313 |
| 2008/0113151 | A1 * | 5/2008 | Liittschwager et al. | 428/99 |

* cited by examiner

*Primary Examiner* — Ryan Kwiecinski
(74) *Attorney, Agent, or Firm* — Harness, Dickey & Pierce, P.L.C.

(57) ABSTRACT

Disclosed is a raised profile panel having various patterns for a door, which allows a user to repair a profile of the door or change a design of the door according to the demand of the user without exchanging the door with a new one when the profile formed on a surface of the door for decoration is damaged or the user wants to change the design of the door. The raised profile panel includes a profile section manufactured separately from the door and having a bonding surface forming an inner wall of the profile section and an exposed surface forming an outer wall of the profile section; and an adhesive layer provided on the bonding surface of the profile section to bond the bonding surface of the profile section with the surface of the door.

14 Claims, 3 Drawing Sheets

RAISED PROFILE PANEL FOR DOOR

CROSS REFERENCE TO RELATED APPLICATIONS

This application claims the benefit and priority of Korean Patent Application No. 2010-0119667 filed Nov. 29, 2011. The entire disclosure of the above application is incorporated herein by reference.

BACKGROUND OF THE INVENTION

1. Field of the Invention

The present invention relates to a door. More particularly, the present invention relates to a raised profile panel for a door, which allows a user to repair a profile of the door or change a design of the door according to the demand of the user without exchanging the door with a new one when the profile formed on a surface of the door for decoration is damaged or the user wants to change the design of the door.

2. Description of the Related Art

In general, a door used at home as an entrance/exit door includes an outer skin made from SMC (sheet molding compound) and urethane foam filled in the door.

In particular, the door is formed on an outer surface thereof with profiles including various patterns or concavo-convex configurations to provide the door with the aesthetic appearance. The profiles are prepared together with other parts of the door when the door is manufactured through a molding process.

However, if the profiles prepared as patterns or concavo-convex configurations are dug or broken, the door must be exchanged with a new one because it is impossible to repair only the damaged profiles. In this case, the user may feel dissatisfaction due to the additional expenses required for exchanging the door.

In addition, as the door has been used for a long time, the user may feel to change the design of the door even though durability of the door is still stable. In this case, the user must exchange the door with a new one having the design required by the user.

SUMMARY

The present invention has been made to solve the problems occurring in the prior art, and an object of the present invention is to provide a raised profile panel having various patterns for a door, which allows a user to repair a profile of the door or change a design of the door according to the demand of the user without exchanging the door with a new one when the profile formed on a surface of the door for decoration is damaged or the user wants to change the design of the door.

In order to accomplish the above object, the present invention provides a raised profile panel for a door. The raised profile panel includes a profile section manufactured separately from the door, having a thickness thinner than a thickness of an outer skin of the door, and including a bonding surface forming an inner wall of the profile section and at least a part of which has a shape corresponding to a shape of a mounting surface formed on the door and an exposed surface forming an outer wall of the profile section and having patterns or concavo-convex configurations according to a demand of a user; and an adhesive layer provided on the bonding surface of the profile section to bond the bonding surface of the profile section with the surface of the door.

According to the present invention, the adhesive layer has a thickness in a range of 0.1 mm to 0.5 mm such that the adhesive layer serves as a damper when the profile section is compressed.

According to the present invention, the adhesive layer is provided on an entire surface of the bonding surface except for at least a region located at a lowest end of the bonding surface when the bonding surface attached to the door.

According to the present invention, the region where the adhesive layer is not provided has a width in a range of 10 mm to 50 mm.

According to the present invention, a coating groove having a step structure is formed at a part of an outer peripheral portion of the bonding surface forming the profile section, in which the part makes contact with the surface of the door, and silicon is filled in the coating groove.

According to the present invention, the silicon is filled in the coating groove except for at least a region located at a lowest end of the coating groove when the profile section is attached to the door.

As described above, the raised profile panel according to the present invention can be used for various purposes, such as repairing the damage to the surface of the door, and changing the local design of the door.

In particular, the raised profile panel according to the present invention includes the bonding surface serving as the inner surface of the raised profile panel and having a shape corresponding to a surface of the door, so the raised profile panel can be stably attached to the door and can reinforce the strength of the installation region.

Further, since the bonding surface serving as the inner surface of the profile section has a shape corresponding to a surface of the door, the raised profile panel can be stably attached to the door and can reinforce the strength of the installation region without requiring an additional assembly jig used for matching the position of the profile section with the surface of the door when the profile section is attached to the surface of the door.

In addition, according to the raised profile panel of the present invention, the adhesive layer of the profile section may not be coated onto the entire surface of the bonding surface of the profile section, but there is a region where the adhesive layer is not coated. The non-coat region is located at the lower portion of the bonding surface when the bonding surface is attached to the door. Thus, an air layer may not be formed when the profile section is installed and the raised profile panel may not be influenced by external factors, such as snow or rain. In particular, the silicon is coated on the outer peripheral portion of the profile section, so external moisture or humidity may not penetrate into the raised profile panel for the door.

DETAILED DESCRIPTION OF THE EMBODIMENTS

Hereinafter, a raised profile panel for a door according to exemplary embodiments of the present invention will be described with reference to FIGS. 1 to 4.

Figure 1:
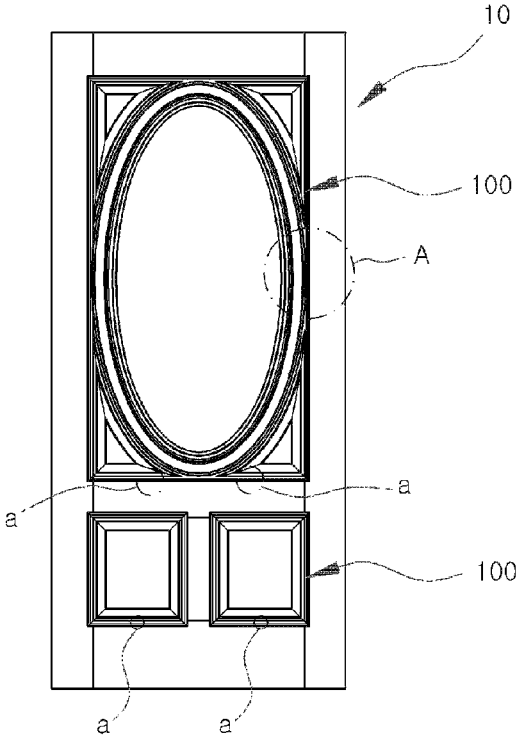
FIG. 1 is a front view showing the installation state of a raised profile panel for a door according to an exemplary embodiment of the present invention.

As shown in FIG. 1, the raised profile panel for the door according to the exemplary embodiment of the present invention mainly includes a profile section 100 and an adhesive layer 200.

In other words, the raised profile panel for the door according to the exemplary embodiment of the present invention has a profile corresponding to a pattern or a concavo-convex configuration formed on a surface (indoor surface or outdoor surface) of the door (10) while allowing a user to repair the profile or to change the design of the door 10.

Hereinafter, the structure of the raised profile panel for the door according to the exemplary embodiment of the present invention will be described in detail.

The profile section 100 is a body of the raised profile panel and is manufactured separately from the door 10.

In particular, the profile section 100 has a thickness thinner than a thickness of an outer skin of the door 10 such that the profile section 100 may have elasticity. Thus, when the profile section 100 is attached to the surface of the door 10, the profile section 100 may not excessively protrude from the surface of the door 10 while accurately adhering to the surface of the door 10.

The profile section 100 includes a bonding surface 120 forming an inner wall of the profile section 100 and an exposed surface 110 forming an outer wall of the profile section 100.

At least apart of the bonding surface 120 has a shape corresponding to a shape of a mounting surface formed on the door 10 and the exposed surface 110 has a pattern or a concavo-convex configuration according to the demand of the user.

Thus, the bonding surface 120 of the profile section 100 may include parts having shapes, which may not correspond to the shape of the mounting surface formed on the door 10. For instance, the parts correspond to edges and regions of the mounting surface which may not exert influence upon the strength.

Otherwise, the bonding surface 120 of the profile section 100 may completely match with the entire surface of the mounting surface including edges of the mounting surface. However, in this case, molding work is very difficult, so the error may occur in shape matching.

Therefore, it is preferred if the region causing the error in shape matching is used to compensate for the shape mismatching when other parts of the bonding surface 120 of the profile section 100 are attached to the surface of the door 10. In this regard, according to the present invention, a part of the bonding surface 120 of the profile section 100 has the shape corresponding to the shape of the mounting surface formed on the door 10. It is more preferred if the bonding position of the bonding surface 120 can be compensated by taking the adhesive layer 200, which will be described later, into consideration.

The adhesive layer 200 is provided to bond the profile section 100 to the surface of the door 10.

Figure 2:
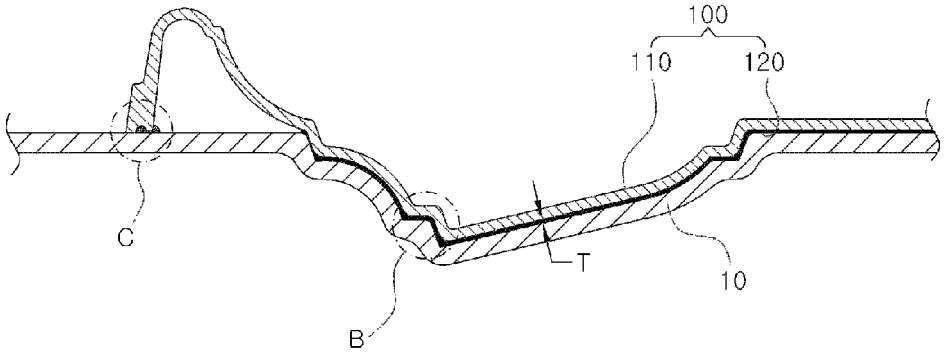
FIG. 2 is an enlarged sectional view showing an internal structure of an "A" part shown in FIG. 1.
Figure 3:
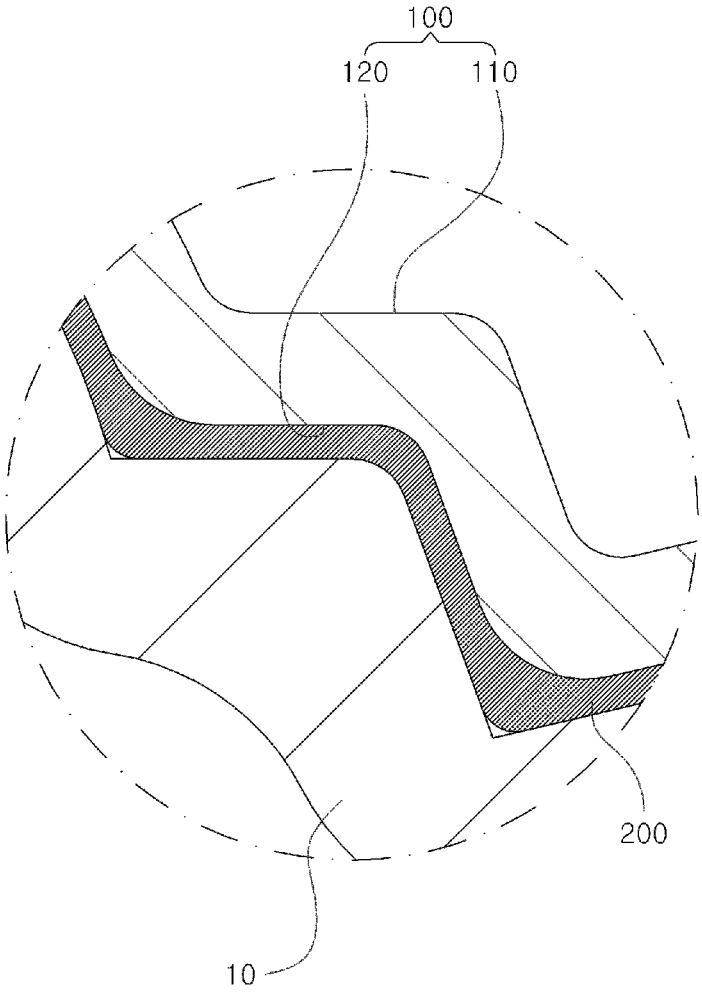
FIG. 3 is an enlarged sectional view showing an internal structure of a "B" part shown in FIG. 2.
Figure 4:
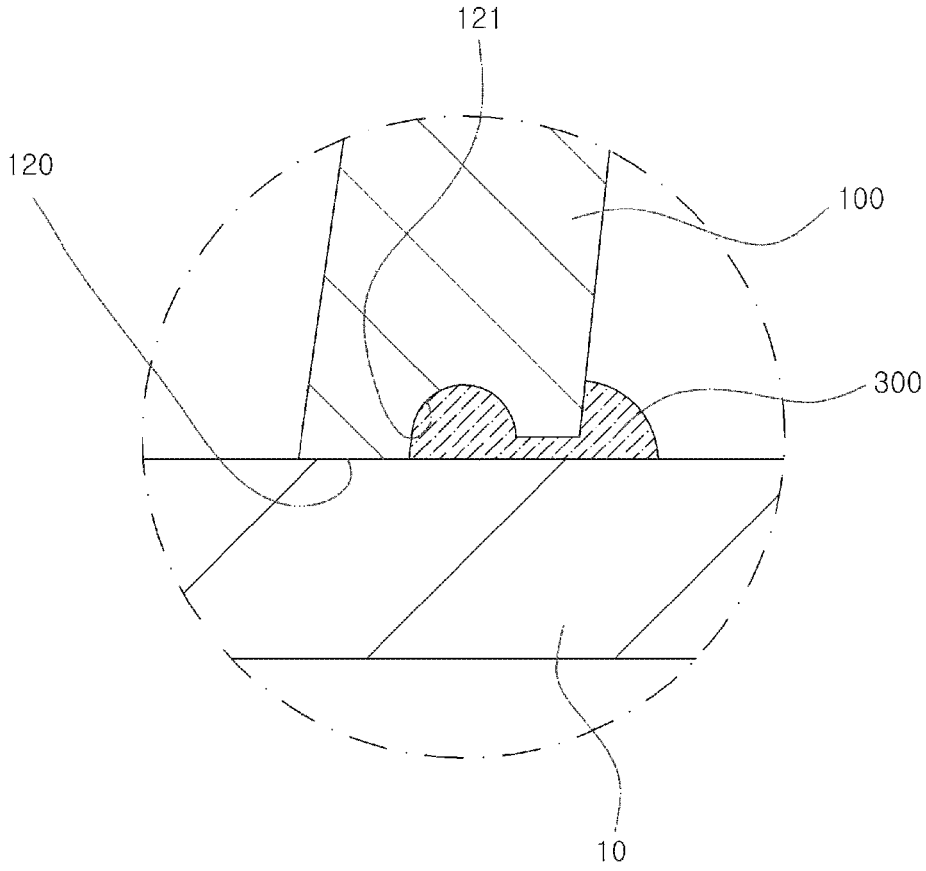
FIG. 4 is an enlarged sectional view showing an internal structure of a "C" part shown in FIG. 2.

The adhesive layer 200 includes an adhesive to bond the profile section 100 to the surface of the door 10. In particular, the adhesive layer 200 has a thickness T in the range of 0.1 mm to 0.5 mm as shown in FIG. 2.

In this case, the adhesive layer 200 serves as a damper when the profile section 100 is compressed, so that durability and weatherability of the profile section 100 can be improved and the profile section 100 can accurately adhere to the surface of the door 10.

If the thickness T of the adhesive layer 200 is less than 0.1 mm, the damping property is lowered so that the durability may be deteriorated. In addition, if the thickness T of the adhesive layer 200 exceeds 0.5 mm, the profile section 100 may be excessively spaced apart from the surface of the door 10. Thus, the above thickness range is preferred for the adhesive layer 200.

Although the adhesive layer 200 can be formed on the entire surface of the bonding surface 120 of the profile section 100, according to the present invention, the adhesive layer 200 is provided on the entire surface of the bonding surface 120 except for at least a region located at a lowest end of the bonding surface 120 when the bonding surface 120 is attached to the door 10.

Due to the above structure, air formed in the profile section 100 and the adhesive layer 200 when the profile section 100 is bonded to the surface of the door 10 can be smoothly drained to the outside through a non-coat region (see, "a" of FIG. 1) where the adhesive layer 200 is not coated, so that the profile section 100 can accurately adhere to the surface of the door 10.

Since the door 10, which is an entrance/exit door used at home, is frequently exposed to the external environment, the non-coat region is located at the lowest end of the bonding surface 120 to prevent moisture, such as snow or rain, from penetrating into the raised profile panel for the door 10.

If the non-coat region is excessively large, the profile section 100 may not securely adhere to the surface of the door 10. In contrast, if the non-coat region is excessively small, the air may not be smoothly drained.

In this regard, the non-coat region preferably has a width in the range of 10 mm to 50 mm.

Therefore, when the surface of the door 10 is locally damaged, the raised profile panel for the door 10 having the above structure may overlap on the damaged surface while being secured by the adhesive layer 200, so that the damaged surface can be easily and simply repaired.

In particular, since the exposed surface of the profile section 100 can be formed with various patterns and configurations, the user can locally change the design of the surface of the door 10.

Meanwhile, according to the raised profile panel for the door having the above structure, if the adhesive layer 200 is coated on the wall part of the outer peripheral portion of the profile section 100 as well as the bonding surface 120 of the profile section, a gap between the profile section 100 and the surface of the door 10 may be exposed to the outside even if the adhesive layer 200 has the thickness in the range of 0.1 mm to 0.5 mm. In this case, moisture or humidity may penetrate into the gap.

Thus, according to the present invention, a coating groove 121 having a step structure is formed at a part of an outer peripheral portion of the bonding surface 120 forming the profile section 100, in which the part makes contact with the surface of the door 10, and silicon 300 is filled in the coating groove 121.

That is, moisture or humidity may penetrate into the raised profile panel for the door due to the silicon 300 filled in the coating groove 121.

In this case, the silicon 300 is filled in the coating groove 121 except for at least a region located at a lowest end of the coating groove 121 when the profile section 100 is attached to the door 10.

In detail, as described above, when the profile section 100 is bonded to the surface of the door 10, the air contained in the profile section 100 and the adhesive layer 200 can be smoothly drained through the non-coat region, in which the adhesive layer 200 is not coated, a non-filling section, in which the silicon 300 is not filled, so that the profile section 100 can accurately adhere to the surface of the door 10.

Meanwhile, the outer peripheral portion of the profile section 100 may have various shapes, other than the flat shape. In detail, as shown in the embodiment, the outer peripheral portion of the profile section 100 may be bent from the surface of the door 10, in such a manner that the outer peripheral portion of the profile section 100 can make contact with the surface of the door 10 due to elasticity.

As described, the raised profile panel according to the present invention can be used for various purposes, such as repairing the damage to the surface of the door 10, and changing the local design of the door 10.

In addition, the raised profile panel according to the present invention includes the bonding surface 120 serving as an inner surface of the profile section 100 and having a shape corresponding to a surface of the door 10, so the raised profile panel can be stably attached to the door 10 and can reinforce the strength of the installation region.

Further, since the bonding surface 120 of the profile section 100 constituting the raised profile panel for the door according to the present invention has a shape corresponding to a surface of the door 10, the profile section 100 can be automatically aligned when the profile section 100 is attached to the surface of the door 10 without requiring an additional assembly jig.

What is claimed is:

1. A raised profile panel for a door, the raised profile panel comprising:

a profile section manufactured separately from the door, having a thickness thinner than a thickness of an outer skin of the door, and including a bonding surface forming an inner wall of the profile section and at least a part of which has a shape corresponding to a shape of a mounting surface formed on the door and an exposed surface forming an outer wall of the profile section and having patterns or concavo-convex configurations according to a demand of a user; and an adhesive layer provided on the bonding surface of the profile section to bond the bonding surface of the profile section with the surface of the door, the adhesive layer is provided on an entire surface of the bonding surface except for a region located at a lowest end of the bonding surface when the bonding surface is attached to the door;

wherein a coating groove having a step structure is formed at a part of an outer peripheral portion of the bonding surface forming the profile section, in which the part makes contact with the surface of the door, and silicon is filled in the coating groove; and wherein the silicon is filled in the coating groove except for a region located at a lowest end of the profile section when the profile section is attached to the door.

2. The raised profile panel of claim 1, wherein the adhesive layer has a thickness in a range of 0.1 mm to 0.5 mm such that the adhesive layer serves as a damper when the profile section is compressed.

3. The raised profile panel of claim 1, wherein the region where the adhesive layer is not provided has a width in a range of 10 mm to 50 mm.

4. A raised profile panel for a door, the raised profile panel comprising:

a profile section including:

a bonding surface forming an inner wall of the profile section;

an exposed surface opposite to the bonding surface, the exposed surface forming an outer wall of the profile section;

a first portion of the profile section including both the bonding surface and the exposed surface, the bonding surface of the first portion is complementary to a mounting surface of the door to which the profile section is configured to be mounted to, the bonding surface of the first portion is configured to be mounted directly to the mounting surface along substantially an entire length of the first portion;

a second portion of the profile section including both the bonding surface and the exposed surface, the bonding surface of the second portion is spaced apart from the mounting surface when mounted to the door, both the bonding surface and the exposed surface of the second portion include concave and convex configurations corresponding to user demand; and an adhesive layer between the entire bonding surface of the first portion and the mounting surface of the door when the profile section is mounted to the door;

wherein a lowest end of the bonding surface relative to a vertical height of the mounting surface of the door includes a region devoid of the adhesive layer when the profile section is mounted to the door;

wherein a distal end of the second portion is configured to contact the mounting surface of the door, the distal end includes:

a first planar portion extending from the exposed surface;

a second planar portion extending from the bonding surface, the second planar portion is recessed beneath the first planar portion such that the second planar portion is spaced apart from the mounting surface when the first planar portion abuts the mounting surface; and a coating groove defined in the distal end between the first planar portion and the second planar portion, the coating groove configured to receive silicon therein, such that the silicon extends from the coating groove across the second planar portion to the bonding surface to secure the distal end to the mounting surface of the door;

wherein a region of the coating groove at a lowest end of the profile section relative to a vertical height of the door is devoid of silicon when the profile section is mounted to the door.

5. The raised profile panel of claim 4, wherein the profile section has a thickness thinner than a thickness of an outer skin of the door.

6. The raised profile panel of claim 4, wherein the region has a width of from about 10 mm to about 50 mm.

7. The raised profile panel of claim 4, wherein the adhesive layer has a thickness of from about 0.1 mm to about 0.5 mm and the adhesive layer is configured to provide a damper for the profile section.

8. The raised profile panel of claim 4, wherein the coating groove defines a stepped structure for receipt of silicon to mount the distal end of the bonding surface to the door.

9. A raised profile panel for a door, the raised profile panel comprising:

a profile section including:

a bonding surface forming an inner wall of the profile section;

an exposed surface opposite to the bonding surface, the exposed surface forming an outer wall of the profile section;

an end surface of the profile section extending between the bonding surface and the exposed surface, the end surface including a mounting portion adjacent to the exposed surface, the mounting portion in direct contact with a mounting surface of the door when the profile section is mounted to the door;

a coating groove including a stepped structure defined by the end surface, the coating groove configured to receive silicon for bonding the end surface to the door, the coating groove extends from about a center portion of the end surface to the bonding surface, the coating groove includes a first area at the center portion that is greater than a second area between the center portion and the bonding surface, the first area is between the mounting portion of the end surface and the second area;

a first portion of the profile section including both the bonding surface and the exposed surface, an entirety of the bonding surface of the first portion is complementary to the mounting surface of the door to which the profile section is configured to be mounted to, the bonding surface of the first portion is mounted directly to the mounting surface;

a second portion of the profile section including both the bonding surface and the exposed surface, the second portion is between the end surface and the first portion, the bonding surface of the second portion is spaced apart from the mounting surface, both the bonding surface and the exposed surface of the second portion include concave and convex configurations corresponding to user demand; and an adhesive layer between the entire bonding surface of the first portion and the mounting surface of the door when the profile section is mounted to the door.

10. The raised profile panel of claim 9, wherein the profile section has a thickness thinner than a thickness of an outer skin of the door.

11. The raised profile panel of claim 9, wherein a lowest end of the bonding surface relative to a vertical height of the door includes a region devoid of the adhesive layer.

12. The raised profile panel of claim 11, wherein the region has a width of from about 10 mm to about 50 mm.

13. The raised profile panel of claim 9, wherein the adhesive layer has a thickness of from about 0.1 mm to about 0.5 mm and the adhesive layer is configured to provide a damper for the profile section.

14. The raised profile panel of claim 9, wherein the first area and the second area of the coating groove define a gap between the end surface and the door to accommodate the silicon when the end surface is mounted to the door.

* * * * *